US005907197A

United States Patent [19]

Faulk

[11] Patent Number: 5,907,197

[45] Date of Patent: May 25, 1999

[54] AC/DC PORTABLE POWER CONNECTING ARCHITECTURE

[75] Inventor: Richard A. Faulk, Cypress, Tex.

[73] Assignee: Compaq Computer Corporation, Houston, Tex.

[21] Appl. No.: 08/885,219

[22] Filed: Jun. 30, 1997

[51] Int. Cl.[6] ..... H01R 13/703

[52] U.S. Cl. ..... 307/119; 439/188; 364/707; 200/51.09; 200/51.1

[58] Field of Search ..... 307/119, 116; 439/488, 188; 200/51.1, 51.09, 51 R; 364/707

[56] References Cited

U.S. PATENT DOCUMENTS

| | | | |
|---|---|---|---|
| 5,174,776 | 12/1992 | Ohtaka et al. | 439/188 |
| 5,674,085 | 10/1997 | Davis et al. | 200/51.1 |
| 5,729,062 | 3/1998 | Satoh | 364/707 |
| 5,758,101 | 5/1998 | Pemberton | 395/283 |
| 5,775,937 | 7/1998 | Bricaud et al. | 200/51 R |

OTHER PUBLICATIONS

Dobberstein et al., "Notch–Programmed Appliance Coupler for Low/high Utility Voltage Discrimination," vol. 27 IBM Technical Disclosure Bulletin, pp. 4237–4239, Dec. 1984.

Ramaswamy et al., "Circuit–level Simulation of CDM–ESD and EOS in Submicron MOS Devices", EOS/ESD Symposium 96–316, p. 6.7.1–6.

Ramaswamy et al., "EOS/ESD Analysis of High–Density Logic Chips" EOS/ESD Symposium 96–285, p. 6.4.1–6.

*Primary Examiner*—Albert W. Paladini

*Attorney, Agent, or Firm*—Robert Groover; Betty Formby

[57] ABSTRACT

A portable computer system which includes a modified C-7 power cord socket, which can receive either an AC power cord with a standard C-7 connector or a DC power cord with a modified C-7 connector. (However, the modified C-7 connector cannot be inserted into a standard C-7 socket.) Microswitches in the modified power cord socket detect the presence of the DC connector, and automatically adjust the power conversion circuit accordingly.

42 Claims, 4 Drawing Sheets

AC/DC PORTABLE POWER CONNECTING ARCHITECTURE

BACKGROUND AND SUMMARY OF THE INVENTION

The present invention relates to portable computer systems which can receive external power from both AC and DC sources.

A typical power cord interfaces to a wall outlet at one end, and interfaces to a standard C-7 type AC connector at the other. The C-7 type AC connector is a widely used standard, and is illustrated in prior art FIG. 1A. This is a non-polarized connector which is normally located on the back of a portable computer. (The C-7 standard is defined by IEC section 320.) C-7 is not the only AC input connector, but is the smallest size which is rated for the 50 W or more power levels normally required for portable computer input.

By attaching the appropriate cord to the C-7 connector, the computer can be configured to operate in the U.S., Japan, U.K., France, Switzerland, Australia, India, etc. Of course, the power supply itself must be able to tolerate the different voltages and frequencies of mains power in these different locations, but power supplies which can accept any AC voltage from 100 volts up through 240 volts are widely available. Thus, the ability to use different power cords with a C-7 connector is very advantageous.

However, the standard definition of a type C-7 connector does not permit it to be used for DC power inputs. Thus, while the capability to accept both DC and AC power inputs is very useful, a separate connector is normally provided on the chassis of computers which can accept such input. (The DC inputs are typically 12 volts, for recharging in a car.) This requires not only separate circuitry, but also separate connectors and cords. Since space on the exterior surface of the chassis is at a premium, this is undesirable.

Innovative Power Connection Architecture

The present application discloses a power connection architecture which permits both DC and AC power cords to be attached to the same socket on a portable appliance. The DC and AC power cords have slightly different terminations, so that the power converter module in the portable appliance can automatically be reconfigured for optimal conversion of whatever power type is being received.

The DC power cord connects to a modification of a standard power input connector (e.g. a female C-7 connector) on the appliance. The DC power cord has one or two added lugs, which indicate that this is a source of DC power rather than AC power, and these added elements PREVENT the DC power cord from connecting to an unmodified standard power input connector. (The other end of the DC power cord connects to a standard DC power source, e.g. a "cigarette lighter" type automotive connector.) Since the modified power cord cannot be inserted into a standard connector, there is no risk of an electrically incompatible power connection.

The AC power cord is a standard cord, which can connect either to a standard power input connector or to the modified power input connector. (The other end of the AC power cord connects to a standard wall socket format.)

The female connector on the computer itself includes inlets corresponding to the lugs on the DC connector, so that the female connector will not only accept the modified DC connector which includes extra lugs, but will also accept and snugly hold a standard (e.g. C-7) AC connector. Preferably the female connector includes microswitches to detect the presence of the lugs which would indicate the presence of a DC connector. Preferably the female connector includes two symmetric openings, so that a DC connector with the extra lug can be inserted in either position.

Optionally the male connector may have only a single lug on it, to indicate the polarity of DC voltage provided, while the female connector may have two lugs, to detect what polarity is being applied. Thus, a single female connector can be used to receive any power voltage from 10 volts DC up through 265 volts AC. The information which may be provided when the switches show the presence of a DC power input can be used in several ways. One way is to enable a boost stage, which boosts the voltage of the DC power input, but does not boost the voltage of an AC power input (or does not boost it as much). Alternatively, a transformer configuration can be used which has a switchable primary coil configuration. By driving a primary which has more turns when the lower-voltage DC input is present, the drive to the transformer can be more nearly equalized.

This provides a simple architecture in which the precious connector space on the computer's small exterior is conserved, while providing users with great flexibility on drawing on different power sources.

Optionally, the parameters of the PWM switching circuit can also be changed in dependence on the type of connector detected.

Optionally, the connector-dependent switching can also be used to switch in a low-voltage capacitor when a low-voltage power input is being received. A low-voltage capacitor can have a much higher capacitance per unit volume than a capacitor which must withstand the full voltages derived from an AC line.

Optionally, the connector-dependent switching can also be used to switch in a low-voltage FET when a low-voltage power input is being received. A low-voltage FET can have a much low on-resistance (for a given package type) than a FET which must withstand the full voltages derived from an AC line.

Optionally, the connector-dependent switching can also be used to switch out a power-factor-correcting boost circuit, or to change the parameters of the power-factor-correcting boost circuit, or to reconfigure the circuit in other ways.

BRIEF DESCRIPTION OF THE DRAWING

The disclosed inventions will be described with reference to the accompanying drawings, which show important sample embodiments of the invention and which are incorporated in the specification hereof by reference, wherein.

DETAILED DESCRIPTION OF THE PREFERRED EMBODIMENTS

The numerous innovative teachings of the present application will be described with particular reference to the presently preferred embodiment. However, it should be understood that this class of embodiments provides only a few examples of the many advantageous uses of the innovative teachings herein. In general, statements made in the specification of the present application do not necessarily delimit any of the various claimed inventions. Moreover, some statements may apply to some inventive features but not to others.

Figure 1A:
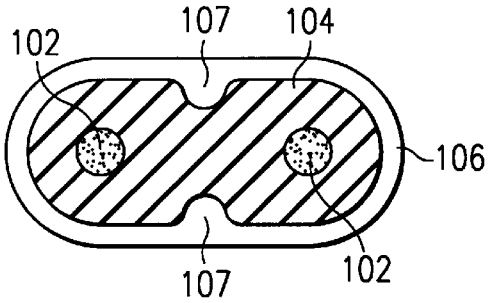
FIG. 1A (PRIOR ART)
FIG. 1A shows a standard C-7 female power cord connector format.

FIG. 1A shows a standard C-7 female power cord connector format. Two connector pins 102 sit within a recess 104 which is surrounded by a nonconductive wall 106.

Figure 1B:
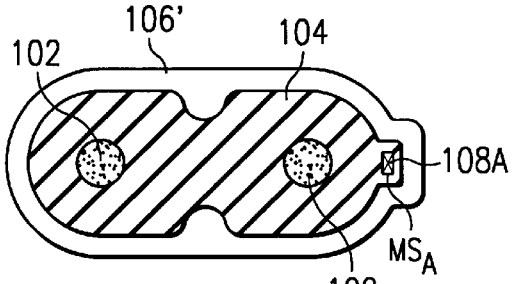
FIG. 1B shows a modified C-7 female power cord connector format, in which an added inlet and microswitch permit detection of either a modified C-7 connector from a DC power source, or an unmodified connector.
Figure 1C:
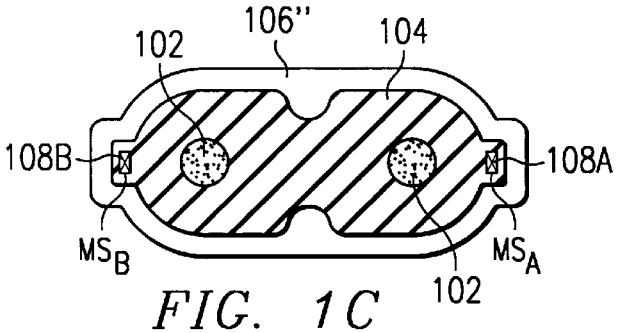
FIG. 1C shows another modified C-7 female power cord connector format, which is symmetrical.
Figure 1D:
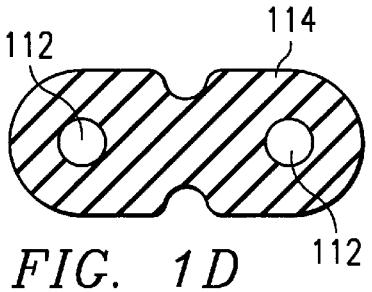
FIG. 1D (PRIOR ART)
FIG. 1D shows a standard C-7 male power cord connector format.

FIG. 1D shows a standard C-7 male power cord connector format. Two sockets 112 in the flat end 114 mate with pins 102 in the female connector of FIG. 1A. The outline of the flat end 114 matches the contour of the interior area 104 of the female connector shown in FIG. 1A (including the interior lugs 107).

Figure 1E:
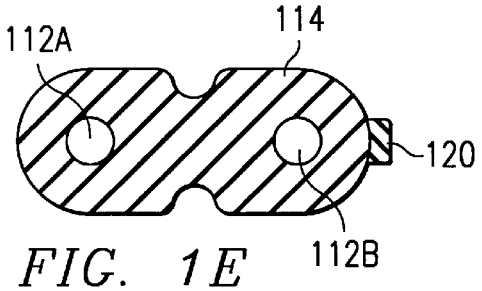
FIG. 1E shows a modified C-7 male power cord connector which includes an added lug 112.

FIG. 1E shows a modified C-7 male power cord connector which includes an added lug 120 to indicate a DC power connection. Since the sockets are no longer symmetrical, one has been designated as 112A and the other is indicated as 112B. The socket 112A can be connected, for example, to a positive supply terminal, and the socket 112B can be connected to the more negative supply terminal.

FIG. 1B shows a modified C-7 female power cord connector format, in which an added inlet 108A and microswitch $MS_A$ permit detection of either the modified C-7 connector of FIG. 1E or the unmodified connector of FIG. 1D. Note that the wall 106' has a slightly different shape from wall 106 in FIG. 1A, to accommodate the added inlet 108A which receives the lug 120. The microswitch $MS_A$ detects whether lug 120 is present.

FIG. 1C shows another modified C-7 female power cord connector format, which is symmetrical. If a male connector like that of FIG. 1E is used, the two microswitches $MS_A$ and $MS_B$ detect whether lug 120 is present, and if so in what orientation.

Figure 1F:
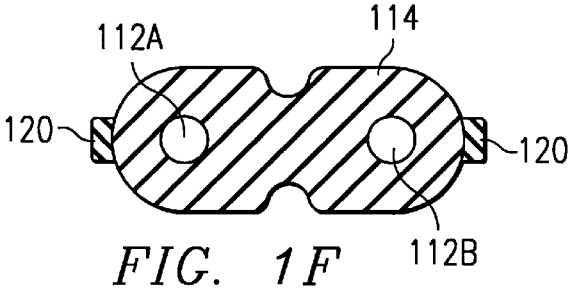
FIG. 1F shows a modified C-7 male power cord connector which includes two added lugs 112.

FIG. 1F shows a modified C-7 male power cord connector which includes TWO added lugs 120. This embodiment is fully symmetrical. When this male connector is used with the connector of FIG. 1C, each of the microswitches MSA and MSB will be activated by one of the lugs 120 when the connector is inserted. This works well with the circuit embodiment of FIG. 3B (described below), since the two microswitches are enough to perform the primary reconfiguration in that circuit.

FIG. 1C shows another modified C-7 female power cord connector format, which is symmetrical. If a male connector like that of FIG. 1E is used, the two microswitches $MS_A$ and $MS_B$ detect whether lug 120 is present, and if so in what orientation.

Figure 2A:
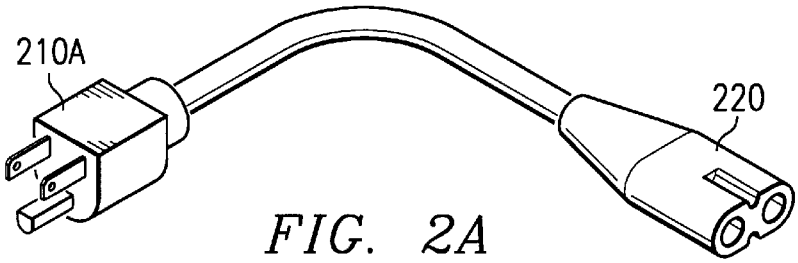
FIG. 2A (PRIOR ART)
FIG. 2A shows a U.S. standard 120 V AC power cord with a conventional C-7 connector.

FIG. 2A shows a power cord with a U.S. standard 120 V AC NEMA plug 210A on one end, and a conventional C-7 connector 220 (like that of FIG. 1D) on the other.

Figure 2B:
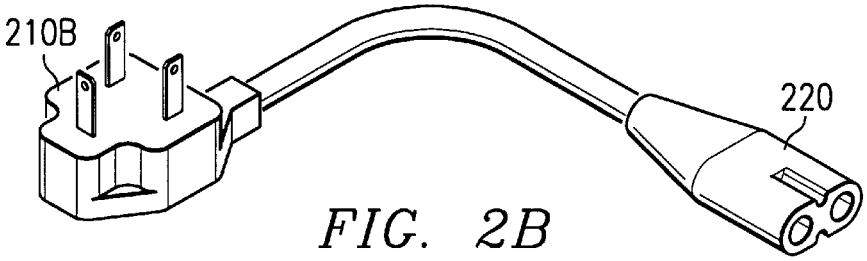
FIG. 2B (PRIOR ART)
FIG. 2B shows a U.K. standard 240 V AC power cord with a conventional C-7 connector.

FIG. 2B shows a power cord with a U.K. standard 240 V AC plug 210B on one end, and a conventional C-7 connector 220 (like that of FIG. 1D) on the other.

Figure 2C:
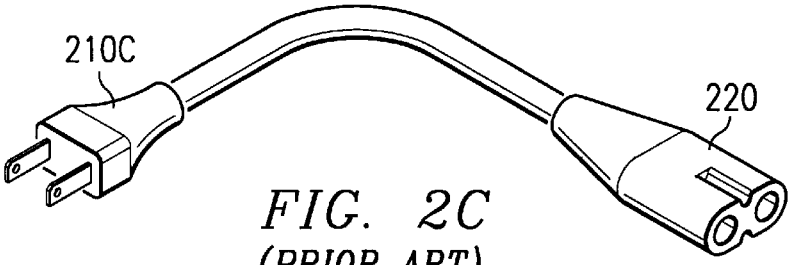
FIG. 2C (PRIOR ART)
FIG. 2C shows a European standard AC power cord with a conventional C-7 connector.

FIG. 2C shows a power cord with a standard French AC plug 210B on one end, and a conventional C-7 connector 220 (like that of FIG. 1D) on the other.

Figure 2D:
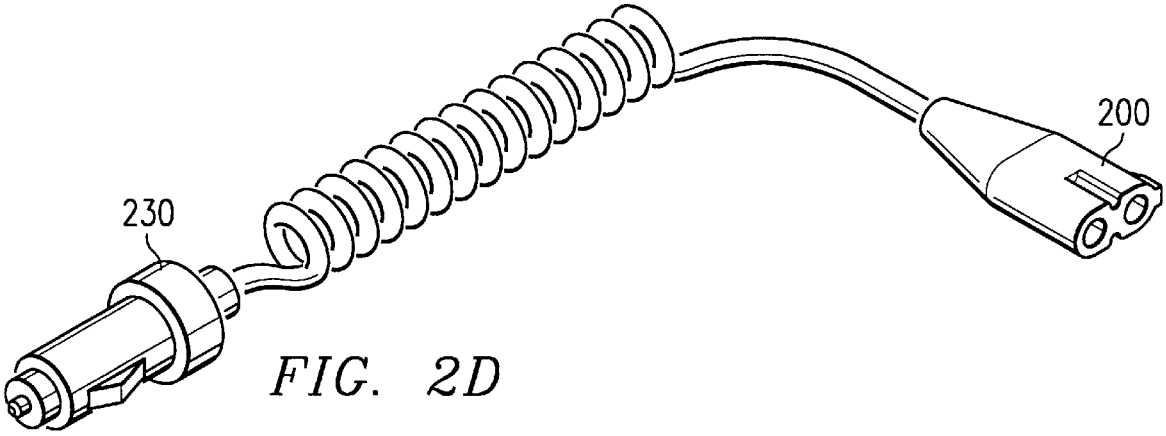
FIG. 2D shows a 12 V DC power cord with a polarized modified C-7 connector.

FIG. 2D shows a 12 V DC power cord with a polarized modified C-7 connector 200 (like that of FIG. 1E, including a lug 120) on one end, and a standard cigarette-lighter-type connector 230 on the other.

Figure 3A:
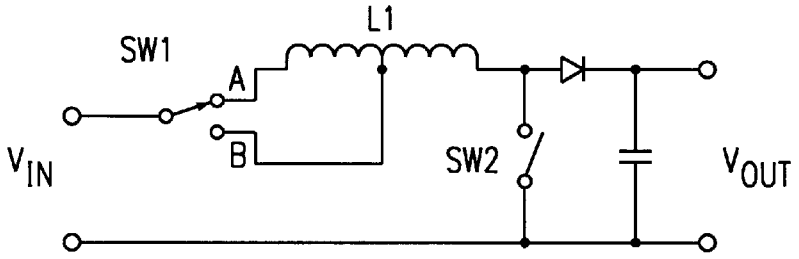
FIG. 3A schematically shows a reconfigurable boost stage.

FIG. 3A shows a selectable boost stage, in which drive can be applied from either an endpoint or a centerpoint of inductor L1. The switch SWI is configured to either position A or position B, in dependence on the microswitches in the female connector. When the switch SWI is in position A, the full impedance of inductor L1 is presented at the input when switch SW2 is closed. As switch SW2 cycles, the inductor L1 will present a high enough impedance to the input voltage to avoid excess current at the switching rate. Conversely, when the switch is in position B, part of the length of the inductor L1 is bypassed, and the inductor L1 therefore presents a lower impedance when switch SW2 is closed. This is more desirable for use with lower input voltages.

Figure 3B:
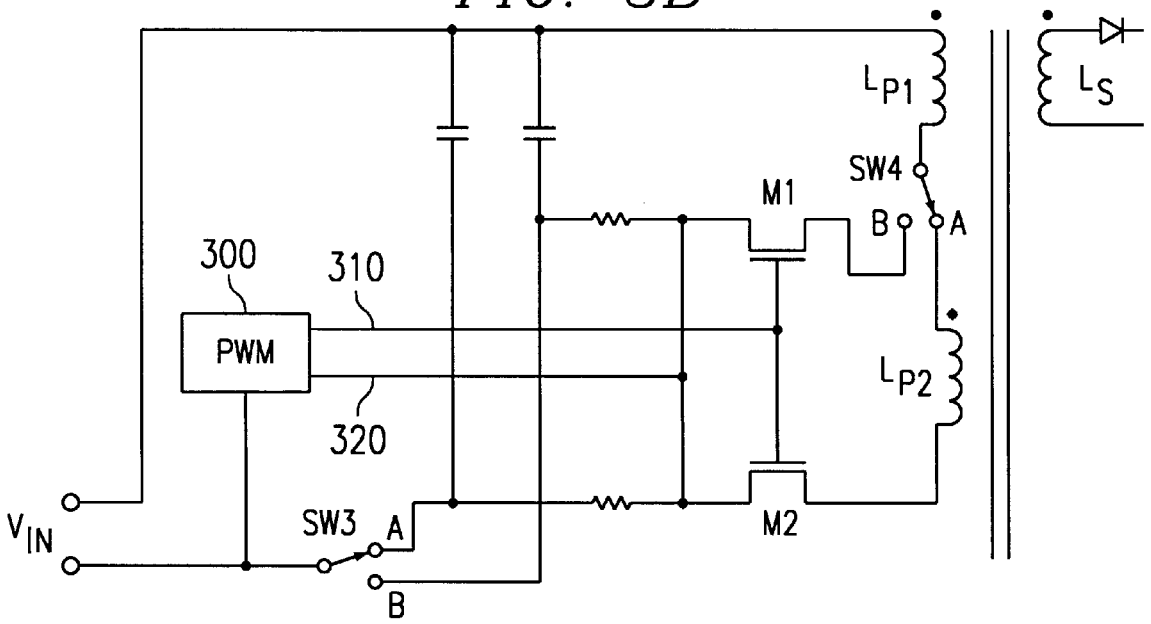
FIG. 3B schematically shows a power conversion stage with a reconfigurable primary coil length.

FIG. 3B shows a reconfigurable primary coil configuration. When switches SW3 and SW4 are in position A, then transistor M1 is floating, and transistor M2 switches current through both parts of the primary (through both primary separate coils $L_{P1}$ and $L_{P2}$). Conversely, when both switches are in position B, transistor M2 is floating, and transistor M1 switches current through only the first primary coil $L_{P1}$. (Switches SW3 and SW4 are preferably connected to switch together.) Preferably primary coil $L_{P2}$ is larger, so that the combined turns of ($L_{P1}$+$L_{P2}$) exceeds the turns of $L_{P1}$ by at least the ratio of the smallest expected AC voltage to the largest expected DC voltage.

PWM driver stage 300 provides drive to both transistors on line 310, and receives current feedback on line 320. (Since one transistor will always be floating, the voltage on the feedback line 320 will be determined by whichever transistor is not floating.) Thus the input voltage Vin will be switched either across shorter primary $L_{P1}$, or else across longer primary $L_{P1}$+$L_{P2}$, to transfer energy into the secondary winding $L_S$.

In a further alternative embodiment, hum-filtering stages can optionally be switched in or out independent on whether the input is AC or DC power.

In a further class of alternative embodiments, a power factor correction circuit can optionally be enabled or disabled, depending on whether the input is AC or DC.

Figure 4:
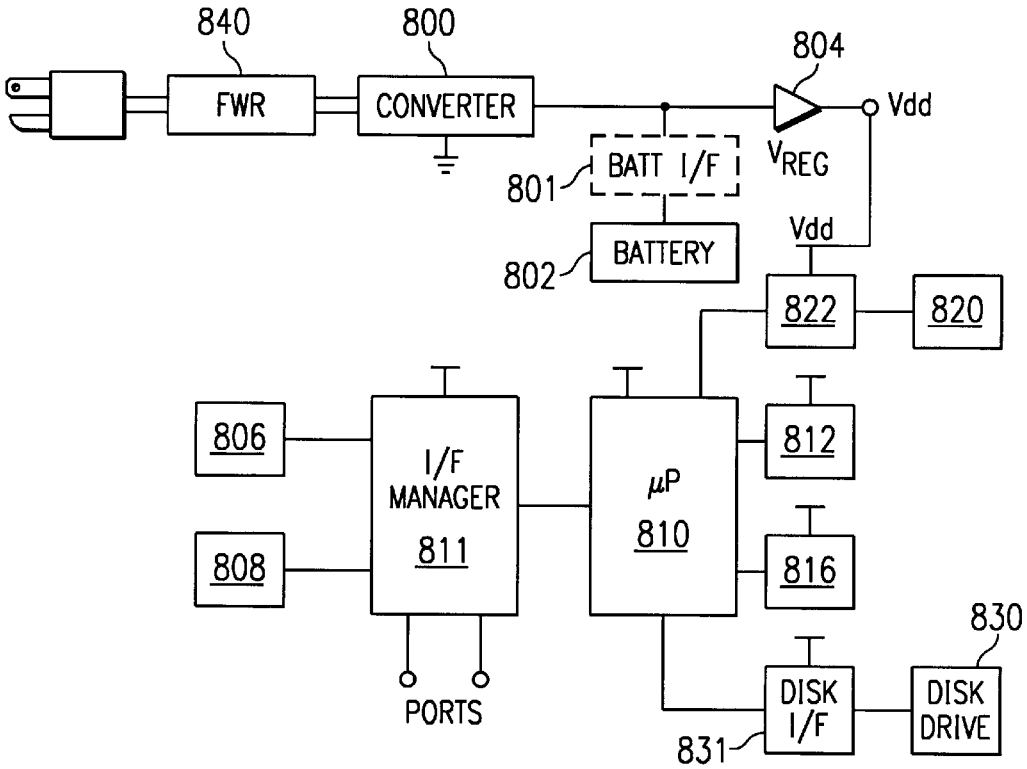
FIG. 4 schematically shows a sample computer system incorporating a power cord connector like that of FIG 1C, and a reconfigurable power conversion stage like that of FIG. 3B.

FIG. 4 shows a sample computer system incorporating a power cord connector like that of FIG. 1C, and a reconfigurable power conversion stage like that of FIG. 3B. FIG. 4 shows a portable computer including a power converter 800 which is used to charge the battery 802. Optionally, a battery interface 801 is interposed between the battery and the rest of the circuitry. The power converter is connected, through a full-wave bridge rectifier FWR, to draw power from AC mains, and is connected to provide a DC voltage to the battery. The battery 802 (or the converter 800), connected through a voltage regulator 804, is able to power the complete portable computer system, which includes, in this example:

user input devices (e.g. keyboard 806 and mouse 808);

at least one microprocessor 810 which is operatively connected to receive inputs from said input device, through an interface manager chip 811 (which also provides an interface to the various ports);

a memory (e.g. flash memory 812 and RAM 816), which is accessible by the microprocessor;

a data output device (e.g. display 820 and display driver card 822) which is connected to output data generated by microprocessor; and a magnetic disk drive 830 which is read-write accessible, through an interface unit 831, by the microprocessor.

Optionally, of course, many other components can be included, and this configuration is not definitive by any means.

Figure 5:
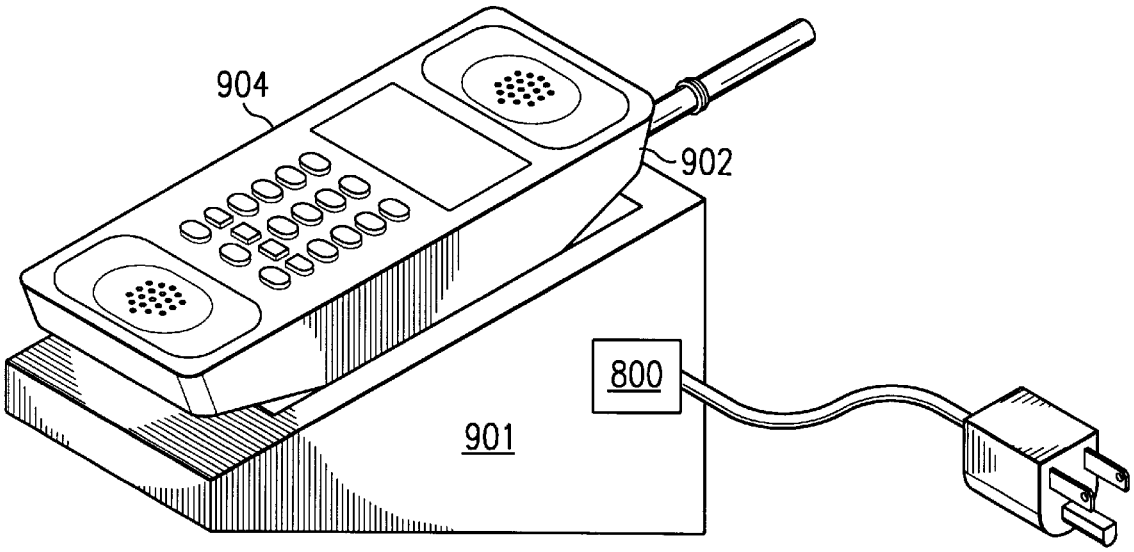
FIG. 5 shows a stand-alone battery charger incorporating a power cord connector like that of FIG. 1C, and a reconfigurable power conversion stage like that of FIG. 3B.

FIG. 5 shows a stand-alone battery charger 901, including a power converter 800, which is used to charge the detachable battery module 902 of a mobile telephone 904 which is placed in the rack of the charger 901. This embodiment incorporates a power cord connector like that of FIG. 1C, and a reconfigurable power conversion stage like that of FIG. 3B. In alternative embodiments, the innovative power architecture can be integrated with other portable electronics.

According to a disclosed class of innovative embodiments, there is provided: An electronic system, comprising: a power supply, and at least one functional component connected to be powered by said power supply; and a power cord connector including a guide structure which snugly receives a standard power cord connector, power contacts which are electrically connected to said power supply, and at least one presence detector which detects the presence of connector portions, on a connector which has been fully inserted into said guide structure, which do not fall within said standard power cord connector footprint; said power supply including at least one component which is connected to be bypassed in dependence on an output of said presence detector.

According to another disclosed class of innovative embodiments, there is provided: A computer system comprising: a power supply containing at least one inductor; a programmable processor and a memory, connected to be powered by said power supply; at least one user input device, and at least one output device; a power cord connector on the exterior of said computer, including a guide structure which snugly receives a standard power cord connector, power contacts which are electrically connected to said power supply, and at least one switch which is mechanically actuated by the presence of connector portions, on a connector which has been fully inserted into said guide structure, which do not fall within said standard power cord connector footprint, and is electrically connected to reroute connections of said power supply, in dependence on whether said presence detector detects the presence of a connector which has a larger footprint than said standard connector.

According to another disclosed class of innovative embodiments, there is provided: A power connector, comprising: a guide structure which is shaped to snugly receive standard AC power cord connectors of a first format, and also to snugly receive power cord connectors of a second format which is partially larger than said first format and is not a standard AC power cord format; power contacts which are electrically connected to pass power; and at least one switch which is actuated when a connector in said second format is fully inserted, but not when a connector in said first format is fully inserted.

According to another disclosed class of innovative embodiments, there is provided: A power connector architecture, comprising: a first power cord having a wall-connection end in a standard AC mains-connection format, and having an appliance end in a standard appliance-connection format for AC power; a second power cord having a wall-connection end in a DC connection format, and having an appliance end which is partly larger than said standard appliance-connection format for AC power; a first electrical appliance having thereon a power-input connector in said standard appliance-connection format, which will receive said first power cord but not said second power cord; and a second electrical appliance having thereon a power-input connector in a modification of said standard appliance-connection format, which will receive either said first power cord or said second power cord, and at least one switch which is actuated by insertion of said first cord but not by insertion of said second cord.

According to another disclosed class of innovative embodiments, there is provided: A method for operating a computer system, comprising the steps of: providing power to a memory from a power supply; providing power to said power supply from a power cord connector on the exterior of said computer, which includes a guide structure which can snugly receive a standard power cord connector, power contacts which are electrically connected to provide power to said power supply, and presence detectors which detect the presence of connector portions, on a connector which has been fully inserted into said guide structure, which do not fall within said standard power cord connector footprint; and changing the electrical connection of components of said power supply in dependence on the output of said presence detector.

According to another disclosed class of innovative embodiments, there is provided: A method for operating a computer system, comprising the steps of: providing power to a memory from a power supply; and providing power to said power supply from a power cord connector on the exterior of said computer, which includes a guide structure which can snugly receive a standard power cord connector, power contacts which are electrically connected to provide power to said power supply, and at least one switch which is mechanically actuated by the presence of connector portions, on a connector which has been fully inserted into said guide structure, which do not fall within said standard power cord connector footprint; wherein said switch connects and disconnects at least one component of said power supply, to optimize said power supply for either an AC input or a DC input.

Modifications and Variations

As will be recognized by those skilled in the art, the innovative concepts described in the present application can be modified and varied over a tremendous range of applications, and accordingly the scope of patented subject matter is not limited by any of the specific exemplary teachings given.

Of course, in implementing power supply circuits and systems, safety is a very high priority. Those of ordinary skill in the art will therefore recognize the necessity to review safety issues carefully, and to make any changes in components or in circuit configuration which may be necessary to improve safety or to meet safety standards in various countries.

It should also be noted that the disclosed innovative ideas are not by any means limited to systems using a single-processor CPU, but can also be implemented in computers using multiprocessor architectures.

For example, while this is particularly advantageous for 12 V DC automotive applications, the power supply can preferably also accommodate other DC input voltages, such as 24 volts, 28 volts, or 32 volts, which are used in various other automotive and maritime applications.

For example, as will be obvious to those of ordinary skill in the art, other circuit elements can be added to, or substituted into, the specific circuit topologies shown.

For another example, within the constraints well-known to those of ordinary skill, power MOS transistors can be replaced by IGBT and/or MCT devices, with appropriate allowance for reduced turn-off times. In some applications power bipolar devices can also be used.

While the disclosed innovations are particularly advantageous for portable computer systems, they can also be applied to other portable electronics.

While the disclosed innovations are particularly advantageous for portable systems, they can also be applied to systems which are not fully portable, but for which use in automobiles or boats is a possibility.

Optionally, the connector-dependent switching can also be used to change other circuit configuration aspects, e.g. to change the configuration of a CEPIC converter front end, or to supply DC current directly into a smart battery module (which includes integral overcurrent protection).

In the sample computer system embodiment the user input devices can alternatively include a trackball, a joystick, a joystick, a 3D position sensor, voice recognition inputs, or other inputs. Similarly, the output devices can optionally include speakers, a display (or merely a display driver), a modem, or other outputs.

What is claimed is:

1. An electronic system, comprising:

a power supply, and at least one functional component connected to be powered by said power supply; and a power cord connector, connected to said power supply, said power cord connector including a guide structure which snugly receives a standard power cord connector, power contacts which are electrically connected to said power supply, and at least one presence detector which detects the presence of connector portions, on a connector which has been fully inserted into said guide structure, which do not fall within said standard power cord connector footprint;

said power supply including at least one component which is selectively connected to said power cord connector in dependence on an output of said presence detector.

2. The system of claim 1, wherein said presence detector is a mechanical switch.

3. The system of claim 1, comprising more than one said presence detector, each configured to detect the presence of separate predetermined respective portions of a connector which has been fully inserted into said guide structure.

4. The system of claim 1, wherein said power supply includes a boost stage having a tapped inductor which is partially bypassed in dependence on the state of said presence detector.

5. The system of claim 1, wherein said power supply includes a transformer having a tapped primary coil which is partially bypassed in dependence on the state of said presence detector.

6. The system of claim 1, wherein said power supply includes first and second switching transistors, with said first switching transistor having a lower withstand voltage than said second switching transistor, and said first switching transistor being conditionally connected in parallel with said second switching transistor in dependence on the state of said presence detector.

7. The system of claim 1, wherein said power supply includes first and second capacitors, with said first capacitor having a lower withstand voltage than said second capacitor, and said first capacitor being conditionally connected in parallel with said second capacitor in dependence on the state of said presence detector.

8. The system of claim 1, wherein said connector includes exactly two of said contacts.

9. The system of claim 1, wherein said connector includes exactly two of said contacts.

10. A computer system comprising:

a power supply containing at least one inductor;

a programmable processor and a memory, connected to be powered by said power supply;

at least one user input device, and at least one output device;

a power cord connector on the exterior of said computer, including;

a guide structure which snugly receives a standard power cord connector;

power contacts which are electrically connected to said power supply, and at least one switch which is mechanically actuated by the presence of connector portions, on a connector which has been fully inserted into said guide structure, which do not fall within said standard power cord connector footprint, and is electrically connected to reroute connections of said power supply, in dependence on whether said presence detector detects the presence of a connector which has a larger footprint than said standard connector.

11. The system of claim 10, comprising more than one said switch.

12. The system of claim 10, wherein said power supply includes a boost stage having a tapped inductor which is partially bypassed in dependence on the state of said switch.

13. The system of claim 10, wherein said power supply includes a transformer having a tapped primary coil which is partially bypassed in dependence on the state of said switch.

14. The system of claim 10, wherein said power supply includes first and second switching transistors, with said first switching transistor having a lower withstand voltage than said second switching transistor, and said first switching transistor being conditionally connected in parallel with said second switching transistor in dependence on the state of said switch.

15. The system of claim 10, wherein said power supply includes first and second capacitors, with said first capacitor having a lower withstand voltage than said second capacitor, and said first capacitor being conditionally connected in parallel with said second capacitor in dependence on the state of said switch.

16. The system of claim 10, wherein said connector includes exactly two of said contacts.

17. A power connector, comprising:

a guide structure which is shaped to snugly receive standard AC power cord connectors of a first format, and also to snugly receive power cord connectors of a second format which is partially larger than said first format and is not a standard AC power cord format;

power contacts which are electrically connected to pass power; and at least one switch which is actuated when a connector in said second format is fully inserted, but not when a connector in said first format is fully inserted.

18. The connector of claim 17, comprising more than one said switch.

19. The connector of claim 17, wherein said power supply includes a boost stage having a tapped inductor which is partially bypassed in dependence on the state of said switch.

20. The connector of claim 17, wherein said power supply includes a transformer having a tapped primary coil which is partially bypassed in dependence on the state of said switch.

21. The connector of claim 17, wherein said power supply includes first and second switching transistors, with said first switching transistor having a lower withstand voltage than said second switching transistor, and said first switching transistor being conditionally connected in parallel with said second switching transistor in dependence on the state of said switch.

22. The connector of claim 17, wherein said power supply includes first and second capacitors, with said first capacitor having a lower withstand voltage than said second capacitor, and said first capacitor being conditionally connected in parallel with said second capacitor in dependence on the state of said switch.

23. The connector of claim 17, wherein said connector includes exactly two of said contacts.

24. A power connector architecture, comprising:

a first power cord having a wall-connection end in a standard AC mains-connection format, and having an appliance end in a standard appliance-connection format for AC power;

a second power cord having a wall-connection end in a DC connection format, and having an appliance end which is partly larger than said standard appliance-connection format for AC power;

a first electrical appliance having thereon a power-input connector in said standard appliance-connection format, which will receive said first power cord but not said second power cord; and a second electrical appliance having thereon a power-input connector in a modification of said standard appliance-connection format, which will receive either said first power cord or said second power cord, and at least one switch which is actuated by insertion of said first cord but not by insertion of said second cord.

25. The architecture of claim 24, wherein said second electrical appliance comprises more than one said switch.

26. The architecture of claim 24, wherein each said connector includes exactly two of said contacts.

27. The method of claim 24, wherein said connector includes exactly two of said contacts.

28. The architecture of claim 24, wherein each said connector includes exactly two of said contacts.

29. A method for operating a computer system, comprising the steps of:

providing power to a memory from a power supply;

providing power to said power supply from a power cord connector on the exterior of said computer, which includes a guide structure which can snugly receive a standard power cord connector, power contacts which are electrically connected to provide power to said power supply, and presence detectors which detect the presence of connector portions, on a connector which has been fully inserted into said guide structure, which do not fall within said standard power cord connector footprint; and changing the electrical connection of components of said power supply in dependence on the output of said presence detector.

30. The method of claim 29, wherein said presence detector is a mechanical switch.

31. The method of claim 29, wherein said power cord connector comprises more than one said presence detector, each configured to detect the presence of separate predetermined respective portions of a connector which has been fully inserted into said guide structure.

32. The method of claim 29, wherein said power supply includes a boost stage having a tapped inductor which is partially bypassed in dependence on the state of said presence detector.

33. The method of claim 29, wherein said power supply includes a transformer having a tapped primary coil which is partially bypassed in dependence on the state of said presence detector.

34. The method of claim 29, wherein said power supply includes first and second switching transistors, with said first switching transistor having a lower withstand voltage than said second switching transistor, and said first switching transistor being conditionally connected in parallel with said second switching transistor in dependence on the state of said presence detector.

35. The method of claim 29, wherein said power supply includes first and second capacitors, with said first capacitor having a lower withstand voltage than said second capacitor, and said first capacitor being conditionally connected in parallel with said second capacitor in dependence on the state of said presence detector.

36. A method for operating a computer system, comprising the steps of:

providing power to a memory from a power supply; and providing power to said power supply from a power cord connector on the exterior of said computer, which includes a guide structure which can snugly receive a standard power cord connector, power contacts which are electrically connected to provide power to said power supply, and at least one switch which is mechanically actuated by the presence of connector portions, on a connector which has been fully inserted into said guide structure, which do not fall within said standard power cord connector footprint;

wherein said switch connects and disconnects at least one component of said power supply, to optimize said power supply for either an AC input or a DC input.

37. The method of claim 36, wherein said power cord connector comprises more than one said switch.

38. The method of claim 36, wherein said power supply includes a boost stage having a tapped inductor which is partially bypassed in dependence on the state of said switch.

39. The method of claim 36, wherein said power supply includes a transformer having a tapped primary coil which is partially bypassed in dependence on the state of said switch.

40. The method of claim 36, wherein said power supply includes first and second switching transistors, with said first switching transistor having a lower withstand voltage than said second switching transistor, and said first switching transistor being conditionally connected in parallel with said second switching transistor in dependence on the state of said switch.

41. The method of claim 36, wherein said power supply includes first and second capacitors, with said first capacitor having a lower withstand voltage than said second capacitor, and said first capacitor being conditionally connected in parallel with said second capacitor in dependence on the state of said switch.

42. The method of claim 36, wherein said connector includes exactly two of said contacts.

* * * * *